US006502616B1

(12) United States Patent
Row

(10) Patent No.: US 6,502,616 B1
(45) Date of Patent: Jan. 7, 2003

(54) APPARATUS AND METHOD FOR FOLDING AND DISPENSING TAPE

(76) Inventor: Scott Whasuk Row, 4599 Bogle Rd., Duluth, GA (US) 30136

( * ) Notice: Subject to any disclaimer, the term of this patent is extended or adjusted under 35 U.S.C. 154(b) by 191 days.

(21) Appl. No.: 09/643,040

(22) Filed: Aug. 21, 2000

Related U.S. Application Data

(60) Provisional application No. 60/211,523, filed on Jun. 14, 2000.

(51) Int. Cl.[7] ..... B32B 31/20

(52) U.S. Cl. ..... 156/463; 156/465; 156/555; 156/579; 156/582

(58) Field of Search ..... 156/555

(56) References Cited

U.S. PATENT DOCUMENTS

| | | | | |
|---|---|---|---|---|
| 648,930 | A * | 5/1900 | Doughty | 156/203 |
| 775,537 | A * | 11/1904 | McConnell | 112/428 |
| 1,279,036 | A * | 9/1918 | String | 112/423 |
| 1,810,585 | A * | 6/1931 | Young | 156/203 |
| 2,309,093 | A | 1/1943 | Borden | |
| 2,581,190 | A | 1/1952 | Hodges | |
| 4,274,904 | | 6/1981 | Harrison et al. | |
| 4,379,019 | | 4/1983 | Pool | |
| 4,425,182 | | 1/1984 | Jones et al. | |
| 4,478,670 | * | 10/1984 | Heyse et al. | 156/200 |
| 4,525,235 | | 6/1985 | Todisco | |
| 4,576,674 | | 3/1986 | Le Tarte | |
| 4,818,329 | | 4/1989 | Tutas et al. | |
| 5,269,871 | | 12/1993 | Longworth et al. | |
| 5,413,658 | * | 5/1995 | Ruggles et al. | 156/199 |
| 5,624,527 | * | 4/1997 | Maresh | 156/466 |
| 5,628,866 | | 5/1997 | Pool | |
| 5,672,233 | | 9/1997 | Hall | |
| 5,678,689 | | 10/1997 | Clark et al. | |
| 5,683,542 | | 11/1997 | Poole | |

FOREIGN PATENT DOCUMENTS

| | | |
|---|---|---|
| DE | 42 08 896 A1 | 9/1993 |
| JP | 9263738 | 10/1997 |
| WO | WO 80/02391 | 11/1980 |
| WO | WO 83/04380 | 12/1983 |

OTHER PUBLICATIONS

Marson Corp. Edge Blender™ Tape Dispenser System, 1987.

* cited by examiner

*Primary Examiner*—Michael W. Ball
*Assistant Examiner*—Gladys Corcoran
(74) *Attorney, Agent, or Firm*—Gardner Groff & Mehrman, P.C.

(57) ABSTRACT

An apparatus and method for folding an adhesive face of tape upon itself and dispensing the folded tape is disclosed. Tape is dispensed from a roll, through a guiding collar having a curved space extending around and defined by a core mounted within a central opening of the guiding collar. As the tape exits the curved space, the tape is correspondingly curved in cross-section, with a portion of the sticky, adhesive face of the tape confronting another portion of the adhesive face. The correspondingly curved tape passes under an element for compressing or pinching the tape, which folds the tape upon itself and compresses the confronting portions of the sticky, adhesive face of the tape together. Rotation of the guiding collar varies the position of the curved space to permit adjustment of the fold width of the tape.

14 Claims, 9 Drawing Sheets

APPARATUS AND METHOD FOR FOLDING AND DISPENSING TAPE

This application claims the benefit of U.S. Provisional Application(s) No(s).: 60/211,523 filing date Jun. 14, 2000.

FIELD OF THE INVENTION

The present invention relates generally to an apparatus and method for folding and dispensing tape or other strip-like material, and more particularly to an apparatus and method for folding an adhesive portion or face of tape upon itself as the tape is dispensed.

BACKGROUND OF THE INVENTION

In the field of painting automobiles, structures and other objects, it is often desirable to "mask" a portion of the object prior to painting to prevent application of paint to that portion. For example, when spray-painting the edge of a car's door or trunk lid, it is often desirable to mask the edge of the door or trunk lid, whereby paint is applied to the exterior-facing door panel, but not to the interior side portions of the door that are not exposed when the door is closed.

Self-adhesive tape, commonly known as masking tape, is commercially available in strip form, in a variety of widths, for use in masking prior to painting. The tape typically is adhesive on a first face, and non-adhesive on a second face opposite the first face. The tape is typically provided in rolls, whereby a long, continuous strip of tape is wrapped about a tubular hollow core.

It has been found to be further desirable, in many instances, to provide a smooth transition between the painted (unmasked) portion and the unpainted (masked) portion (rather than a stark, clearly-defined line as would normally occur where tape was applied to the object before painting and the tape removed after painting). It is known to apply a sponge rope material such as Soft-Edge Foam, commercially available from 3M Corp. Minneapolis, Minnesota, having a generally circular cross-section and an adhesive coating or strip applied along its length at the edge of the object to be painted, whereby a tapered channel or space is formed between the painted object and the outer circumference of the sponge rope. Sprayed paint will enter this tapered space to some extent, and will be applied to the painted object to a greater extent at the entrance to the space and to a progressively lesser extent further into the space. At the point of adhesion, no paint will be applied. In this manner, the application of paint fades relatively smoothly from the painted portion to the unpainted portion of the object.

The sponge tape, however, is very expensive. In an effort to reduce expenses, but still provide a smooth transition between the unmasked painted portion and the masked unpainted portion, it is known to manually fold one edge of the adhesive face of a length of masking tape upon itself, thereby forming a strip of tape having a face that is adhesive along one edge (the unfolded edge) and non-adhesive along the other edge (the folded edge). This strip of tape is then applied to the edge of the object to be painted, with the adhesive edge adhered to the object and the non-adhesive edge tapering away from the object, to form a tapered space between the tape and the object to be painted. When paint is sprayed in the area of the tape, some paint enters this tapered space in much the same manner as with the sponge rope, fading progressively from the entrance of the space toward the point of adhesion of the tape. The effort required to manually fold the tape, however, is relatively time-consuming and, therefore, is expensive in its own right.

In addition to the above-described edge-painting method, it has been found to be desirable in a number of other applications to fold a segment of the adhesive face of a strip of tape upon itself. For example, when painting along the edge of wall trim in a house, it is often desirable to mask the trim or the adjacent wall to prevent overpainting. Folding a segment of the adhesive face of the tape upon itself would facilitate removal of the tape, after the painting is complete, by providing a non-adhered "tab" that is easy to grip and pull.

Accordingly, a need yet exists for an economical way of folding an adhesive face of tape upon itself. It is to the provision of an apparatus and method meeting this and other needs that the present invention is primarily directed.

SUMMARY OF THE INVENTION

In accordance with the purpose(s) of this invention, as embodied and broadly described herein, the present invention relates to an apparatus and method for folding and optionally bending an adhesive face of tape upon itself and dispensing the tape.

In one aspect, the apparatus comprises a guiding collar having a curved opening therethrough for receiving and passing a length of tape to form a curved segment of tape, wherein a portion of the adhesive face of the tape confronts another portion of the adhesive face; and a compressing element to compress the confronting portions of the adhesive face of the tape against one another and fold the tape upon itself.

In another aspect, this invention relates to an apparatus comprising a guiding collar having a curved opening therethrough for receiving and passing a length of tape to form a curved segment of tape, wherein a portion of the adhesive face of the tape confronts another portion of the adhesive face; a compressing element to compress confronting portions of the adhesive face of the tape against one another and fold the tape upon itself; and means for bending at least one edge of the tape.

In yet another aspect, the present invention relates to an apparatus comprising an adjustable guiding collar having a curved opening therethrough for receiving and passing a length of tape to form a curved segment of tape, wherein a portion of the adhesive face of the tape confronts another portion of the adhesive face, and wherein the adjustable guiding collar varies the fold width of the tape; and a first compressing element to compress confronting portions of the adhesive face of the tape against one another and fold the tape upon itself.

In yet another aspect, the present invention relates to a method of folding an adhesive face of tape upon itself comprising passing tape through a curved opening to form a segment of tape having a curved cross-section, wherein the segment of tape has a portion of the adhesive face of the tape confronting another portion of the adhesive face; and compressing the confronting portions of the adhesive face of the segment of tape to fold the tape upon itself.

Preferably, the apparatus and method of the present invention enable the user to selectively adjust the amount of tape folded over, from a minimum fold extent, which can be a configuration wherein the tape is not folded and the apparatus serves merely to dispense tape, to a maximum fold extent where, for example, the tape is folded in half. The guiding collar is, in one aspect, rotationally mounted within a sleeve to permit adjustment of the width of fold of the tape from either side edge of the tape. In another aspect, the tape is dispensed through at least one compressing element and a rail channel corresponding to and cooperating with the compressing element to fold and bend the tape, thereby forming an area of the tape that may be gripped and pulled easily by a user.

Additional advantages of the present invention will be set forth in part in the detailed description and appended drawing figures, which follow, and in part will be more apparent from the description and drawing figures, or may be learned by practice of the invention. The advantages of the invention will be realized and attained by means of the elements and combinations particularly pointed out in the appended claims. It is to be understood that both the foregoing general description and the following detailed description are exemplary and explanatory of preferred embodiments of the present invention, and are not restrictive of the invention, as claimed.

BRIEF DESCRIPTION OF THE DRAWING FIGURES

DETAILED DESCRIPTION OF THE INVENTION

Figure 1:
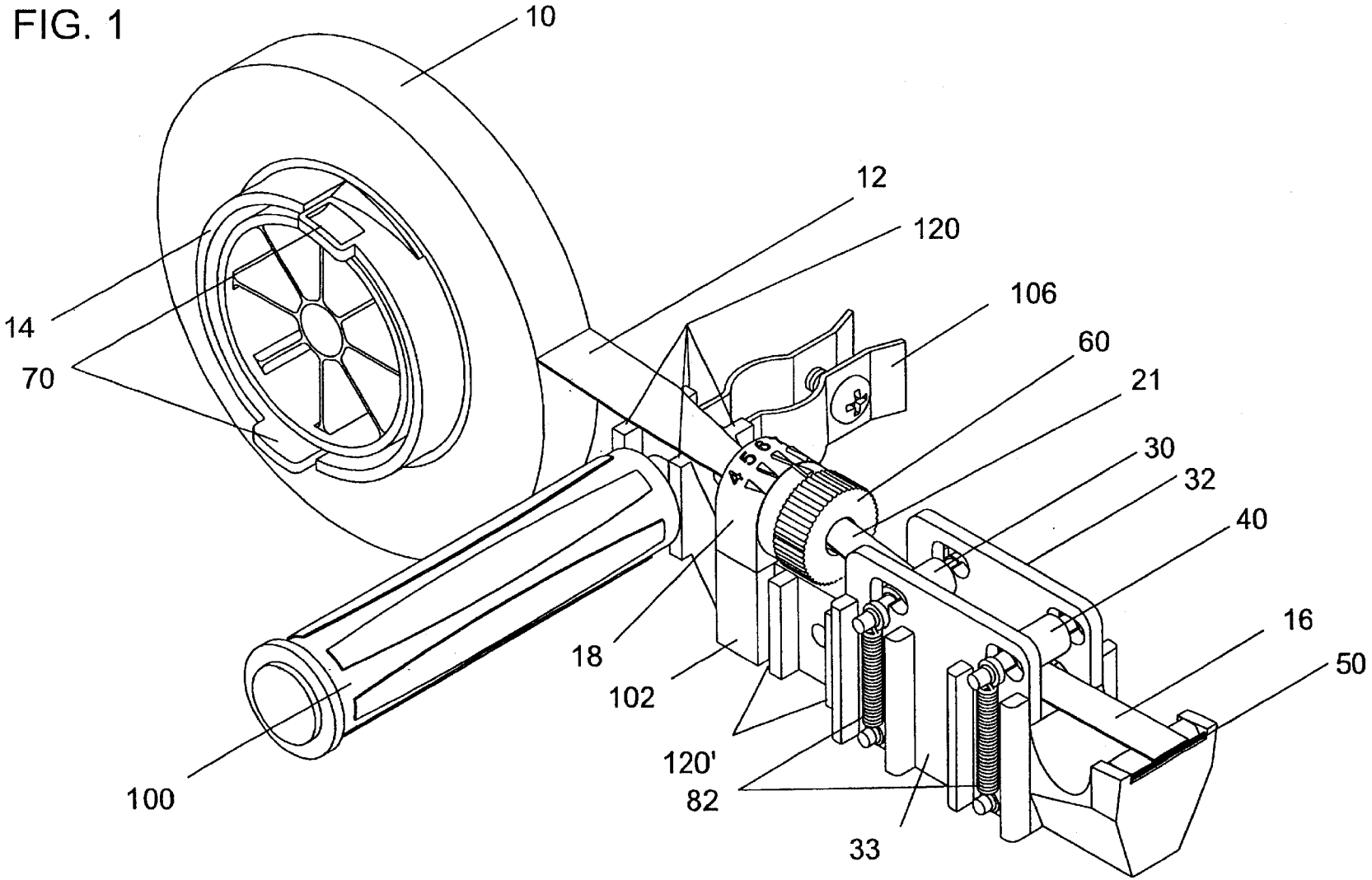
FIG. 1 is a perspective view of an apparatus for folding and dispensing tape according to a preferred form of the present invention.

The present invention may be understood more readily by reference to the following detailed description of the invention and the drawing figures. It is to be understood that this invention is not limited to the specific elements and methods described, as specific elements and methods may, of course, vary. It is also understood that the terminology used herein is for the purpose of describing particular embodiments only and is not intended to be limiting. It must also be noted that, as used in the specification and the appended claims, the singular forms "a," "an" and "the" include plural references, unless the context clearly dictates otherwise.

Referring now to the drawing figures, wherein like reference numerals represent like parts throughout, preferred forms of the present invention will be described. FIGS. 1–4 and FIGS. 5–7 show example embodiments of an apparatus 5, 5' for folding an adhesive face of a strip of tape upon itself, according to preferred forms of the present invention.

Figure 2:
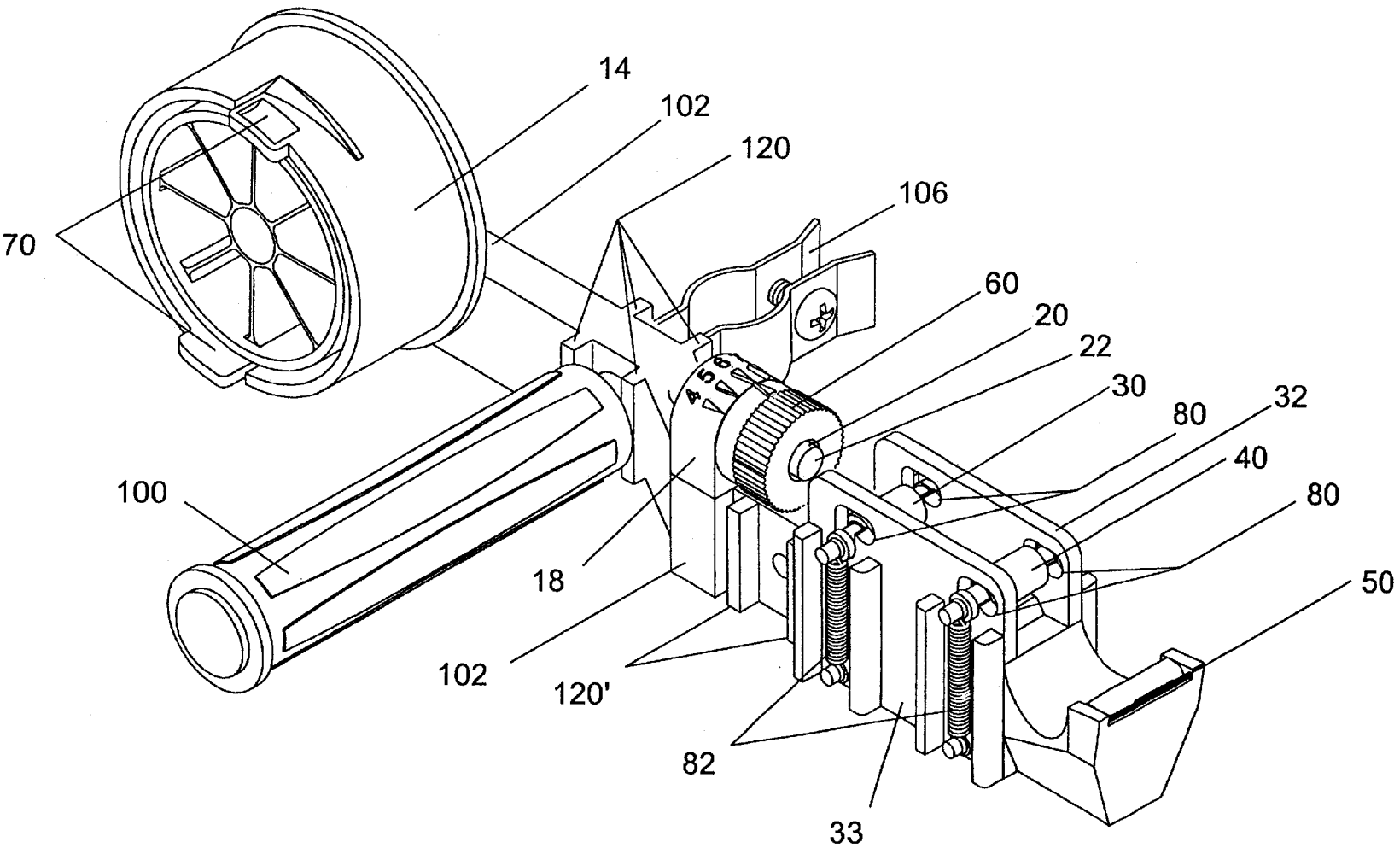
FIG. 2 is a perspective view of the apparatus of FIG. 1 without tape.
Figure 3:
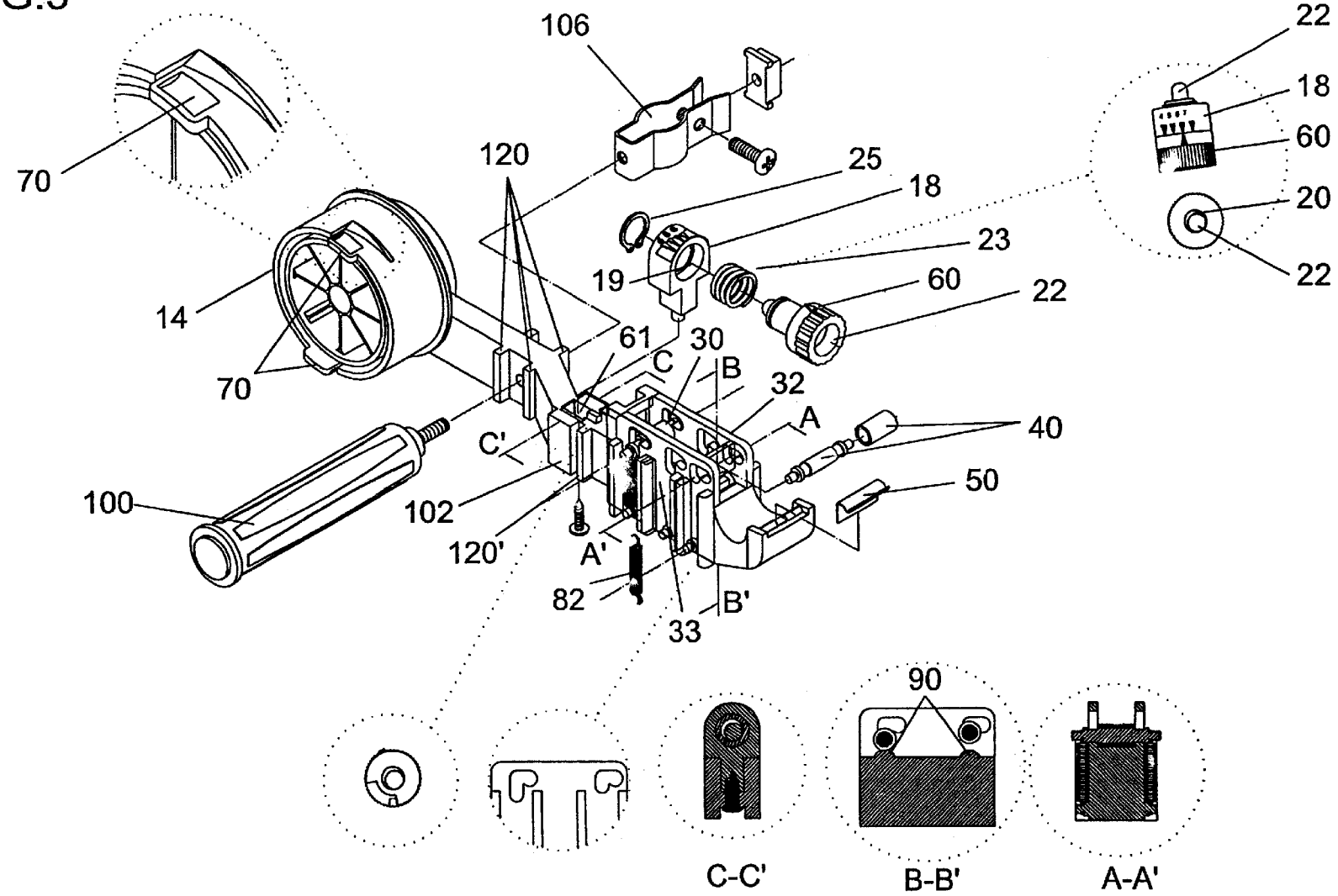
FIG. 3 shows an exploded perspective view and several cross-sectional views of the apparatus of FIG. 1.

Referring to FIGS. 1–4 in particular, a roll 10 of tape 12 is held on a roll holder 14 at one end of the apparatus shown generally at 5. Apparatus 5 has a main body shown at 15 for mounting the components of apparatus 5 thereon. A free end 16 of the tape 12 is dispensed from roll 10, through a guiding collar or knob 17 housed and rotationally mounted within opening 19 of sleeve 18 using a spring 23 and retaining ring 25 (FIG. 3). The tape passes through a curved, partially annular opening or space 20 (as shown in FIGS. 2 and 3). A "curved opening" is any opening that causes tape to have an adhesive face of the tape confront itself. This may include but is not limited to a soft curve or an angular opening defined by linear segments. Preferably, a core 22 is cylindrical and defines curved opening 20 within guiding collar or knob 17.

As the tape exits the curved opening 20, each segment 21 of tape 12 is correspondingly curved in cross-section, with the bottom, sticky face (not shown) of segment 21 being concave and the top, non-sticky face of segment 21 being convex. In other words, as tape 12 exits the curved space 20, the segment 21 of tape 12 is correspondingly curved in cross-section wherein a portion of the adhesive face of the tape confronts another portion of the adhesive face.

Figure 4:
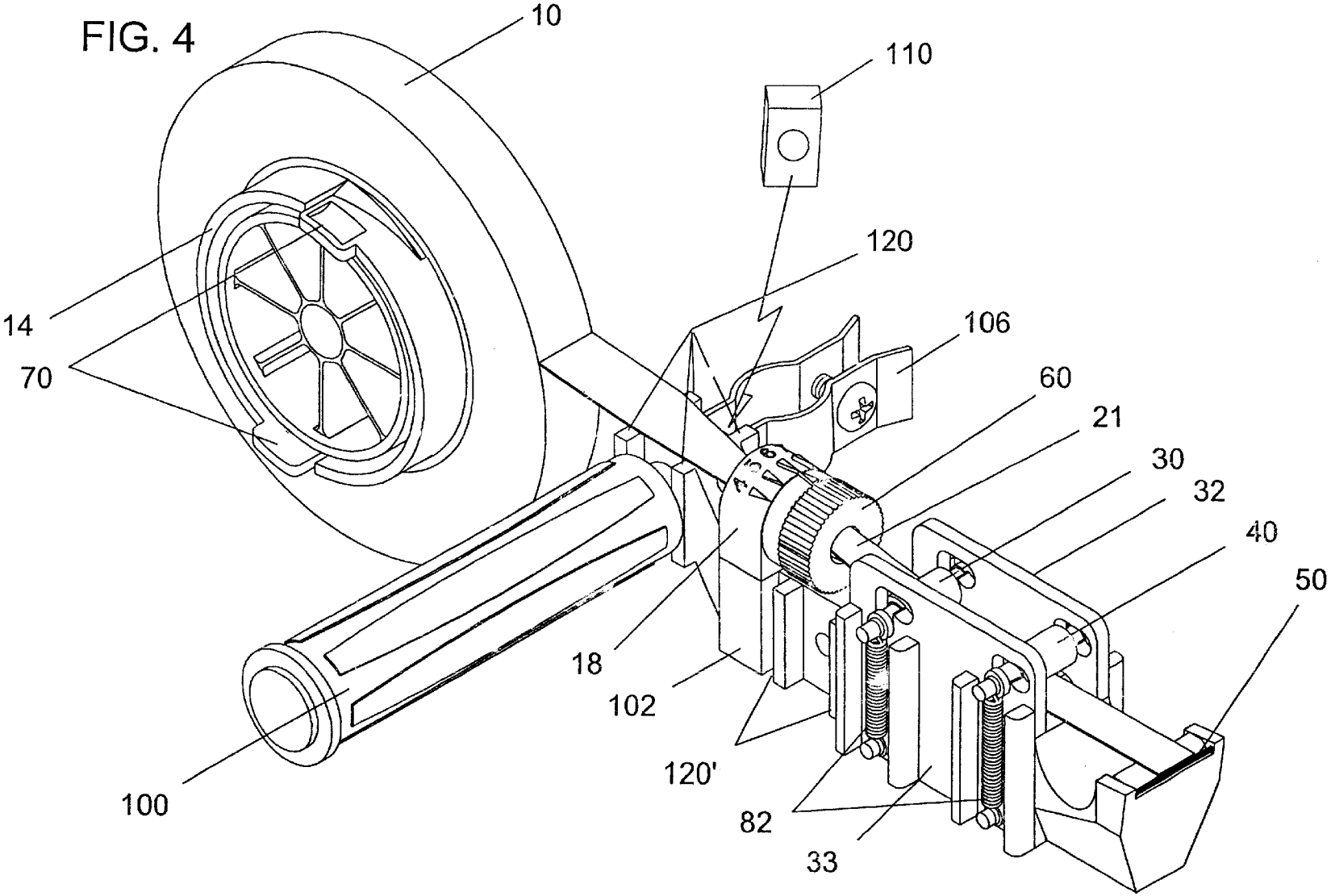
FIG. 4 is a perspective view of the apparatus of FIG. 1, with the provision of a handle nut for use when the apparatus is used as a portable hand tool rather than as a stationary-mounted tool.
Figure 5:
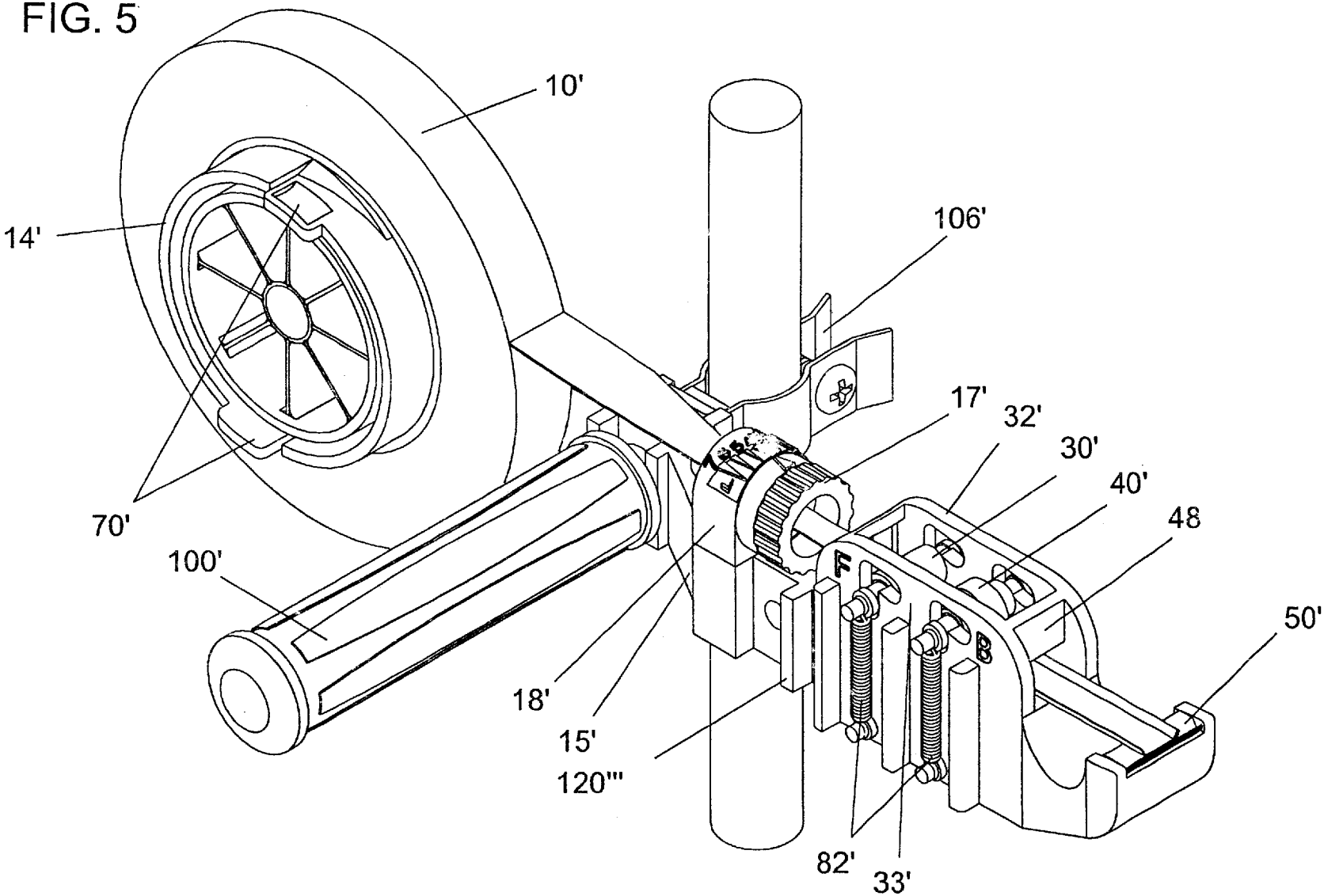
FIG. 5 is a perspective view of another embodiment of an apparatus for folding and dispensing tape according to a preferred form of the present invention, shown with a right-hand mounted handle and clip-mounted to a support.
Figure 6:
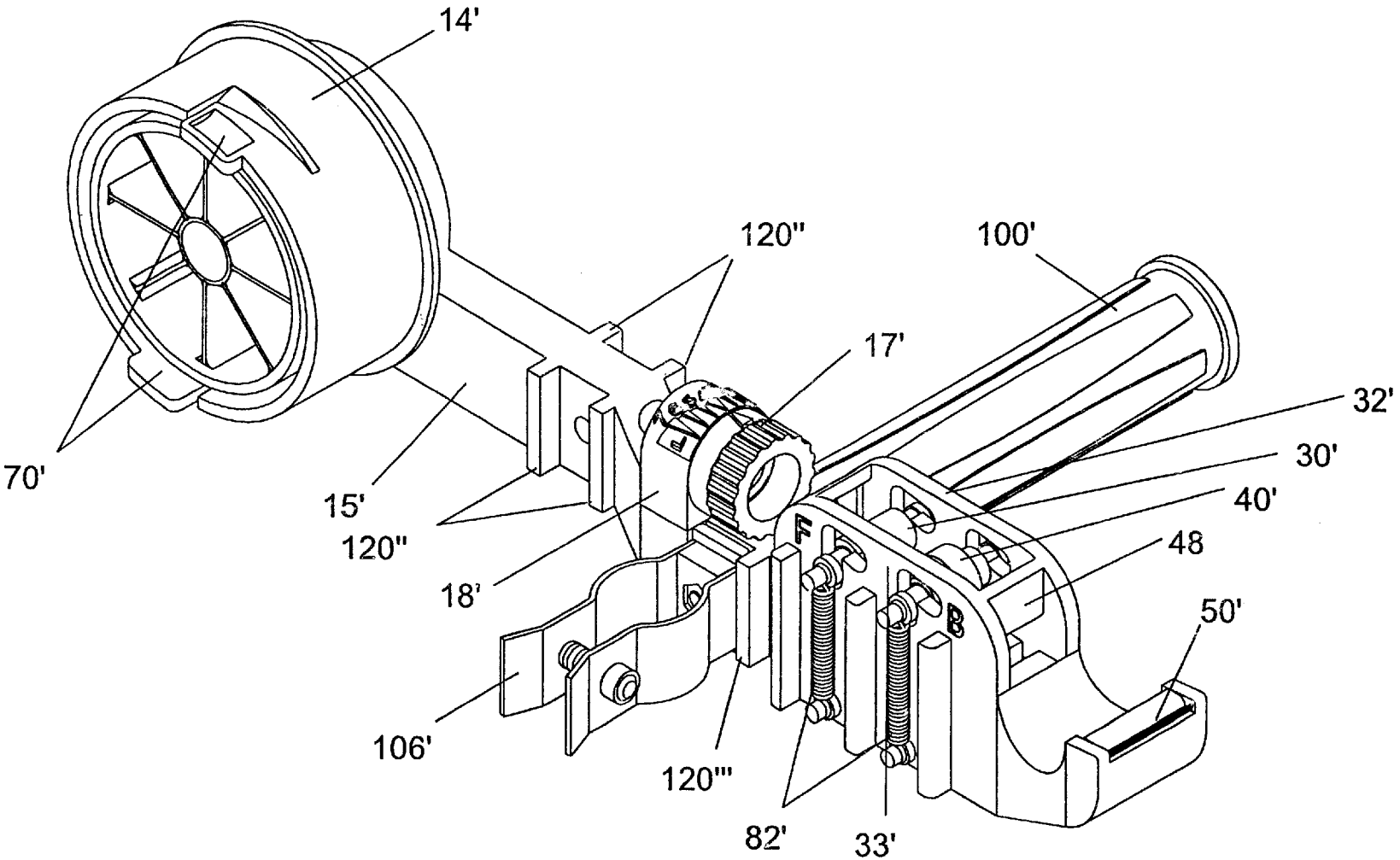
FIG. 6 is a perspective view of the apparatus of FIG. 5, shown with a left-handed mounted handle.

As shown in FIGS. 1 and 4, segment 21 of curved tape 12 passes under a first compressing element 30, which folds the tape upon itself and compresses the confronting portions of the sticky, adhesive face of the tape together. The compressing element may be a pinch roller (as shown in FIGS. 1–7), or may be a cylindrical bar, an edge of the apparatus, or any other like element that compresses the confronting portions of the adhesive face of the tape together. The inner faces of the panels 32 and 33 serve as a guide to position the curved tape as it enters under the first compressing element 30.

A second compressing element 40 is optional, and is primarily used to provide a roller bearing for contacting the top (non-sticky) face of the tape 12 as it is pulled toward the cutter blade 50. In the embodiments of FIGS. 1–4, the second pinch roller 40 preferably does not further compress the folded tape, but rather serves to position the tape during dispensing and cutting (see Section B–B' in FIG. 3).

The guiding collar or knob 17 is generally cylindrical in shape and is rotationally mounted within opening 19 of sleeve 18. Collar 17 can be rotated within the sleeve 18 to adjust how much of the tape 12 is folded over upon itself. Preferably, indicia is located on guiding collar 17 and/or sleeve 18 to mark and allow a user to fold certain widths of tape. For example, a sample length of tape may vary from being folded at about the midpoint of the tape's width to being not folded at all. The indicia aids the user in creating folded tape of varying widths, as desired. The fold width adjustment is accomplished by rotating the cylindrical core 22, which is eccentrically mounted within a central opening of the guiding collar 17. The cylindrical core 22 defines a curved space 20, preferably generally centrally located within the guiding collar 17, to pass a tape there through and form a segment of tape correspondingly curved in cross-section. The cylindrical core and curved space defined by the core move eccentrically within the sleeve 18 as the guiding collar 17 is rotated to vary the position and orientation of the partially annular space 20, and thereby vary the positioning of the curved tape as it enters the first compressing element 30. A positional stop 61 (shown in FIG. 3) is preferably provided to limit the extent of rotation of the guiding collar 17.

In one embodiment of the invention, rotation of the guiding collar 17 against the stop 61 in a first direction allows dispensing of the tape without a fold, whereby the apparatus functions as a regular, non-folding tape dispenser. Rotation of the collar 17 against the stop 61 in the opposite direction provides for maximum folding of the tape.

In a more preferred embodiment of the invention, rotation of guiding collar 17 against the stop 61 a in one direction allows dispensing of the tape with a fold stemming from the left edge of the tape. Rotation of guiding collar 17 against the stop 61 in the other direction allows dispensing of the tape with a fold stemming from the right edge of the tape. Rotation of guiding collar 17 to a point approximately midway between the stop 61*a* and the stop 61*b* allows dispensing of the tape without a fold whereby the apparatus functions as a regular, non-folding tape dispenser. Rotation of the collar 17 against the stop in either direction provides maximum folding of the tape.

The roll holder 14 preferably includes one or more resilient retaining clips 70 for releasably holding or securing the roll 10 of tape thereon. The compressing elements, e.g. pinch rollers, are carried within retaining slots 80, and springs 82 bias the pinch rollers 30, 40 downwardly when the apparatus is loaded and in use. The retaining slots 80 include offsets which allow the pinch rollers 30, 40 to be held in a raised position for loading tape, and to be lowered into a spring biased position for folding and dispensing tape. As seen best with reference to Section B–B' in FIG. 3, raised ribs 90 are preferably provided beneath the pinch rollers 30, 40 to minimize the surface area contacting the adhesive face of the tape, thereby providing smoother dispensing of the tape.

A handle 100 is provided for grasping by the user during use. The handle 100 is preferably releasably affixed to the main body 15 of the apparatus 5, by means of a threaded stud 104, which extends through a hole in the body 15 and engages a threaded opening of a mounting clip 106. The mounting clip 106 preferably comprises resilient jaws for releasably mounting the apparatus 5 onto a tool cart, masking rack or station or other external structure during use. The mounting clip 106 can be releasably affixed on either the right or left side for mounting the apparatus onto an external structure on either side of the main body 15.

Alternatively, if the apparatus is to be utilized as a portable hand tool, a nut 110 can be provided in place of the mounting clip 106. Removal of the mounting clip 106 is preferred when utilized as a portable hand tool, in order to reduce the likelihood of the clip 106 scratching the finish of the object being painted. The handle 100 is reversible, and can be mounted on either side of the main body 15, depending upon whether the user is right-handed or left-handed. The main body 15 preferably comprises mounting lugs 120 for more secure engagement of the handle 100 and the mounting clip 106. Preferably, the handle 100 can be mounted at two or more positions spaced along the main body 15 (represented by mounting lugs 120 and 120'). The offset in main body 15 allows handle to be reversibly mounted to support without support interfering with tape dispensing.

Figure 7:
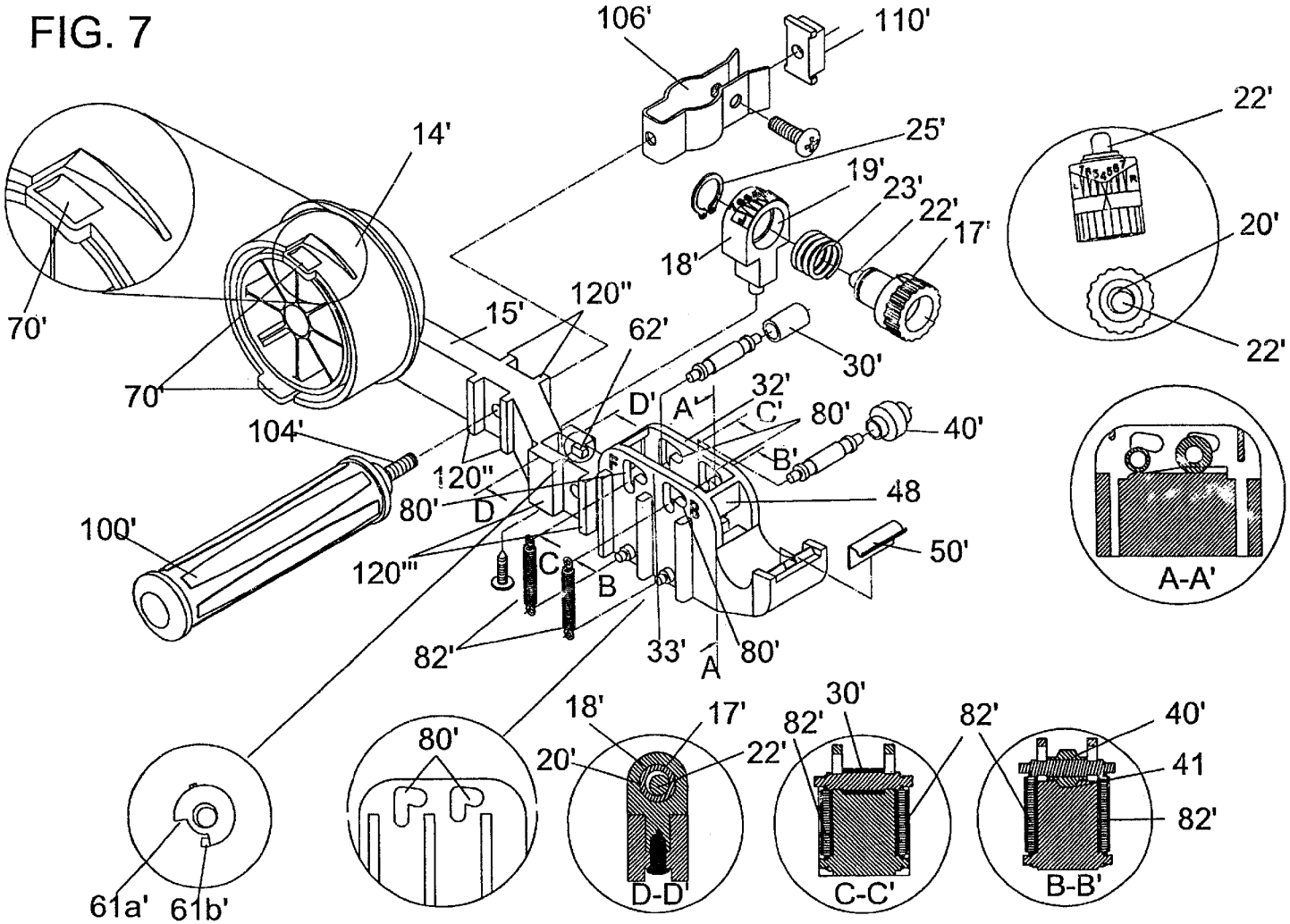
FIG. 7 is an exploded perspective view and several cross-sectional views of the apparatus of FIG. 5.
Figure 8:
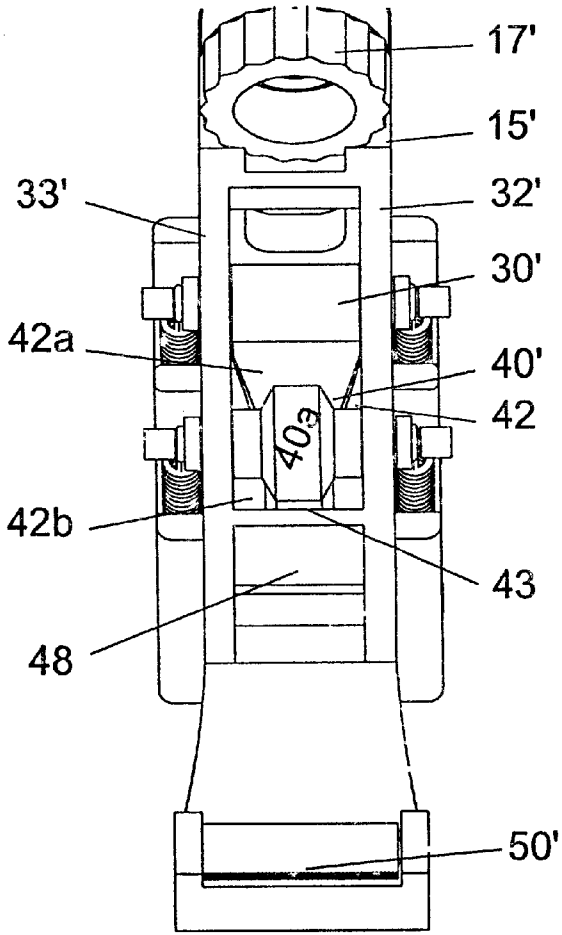
FIG. 8 is an elevational perspective view of the folding, bending and cutting portions of the apparatus of FIG. 5.
Figure 9:
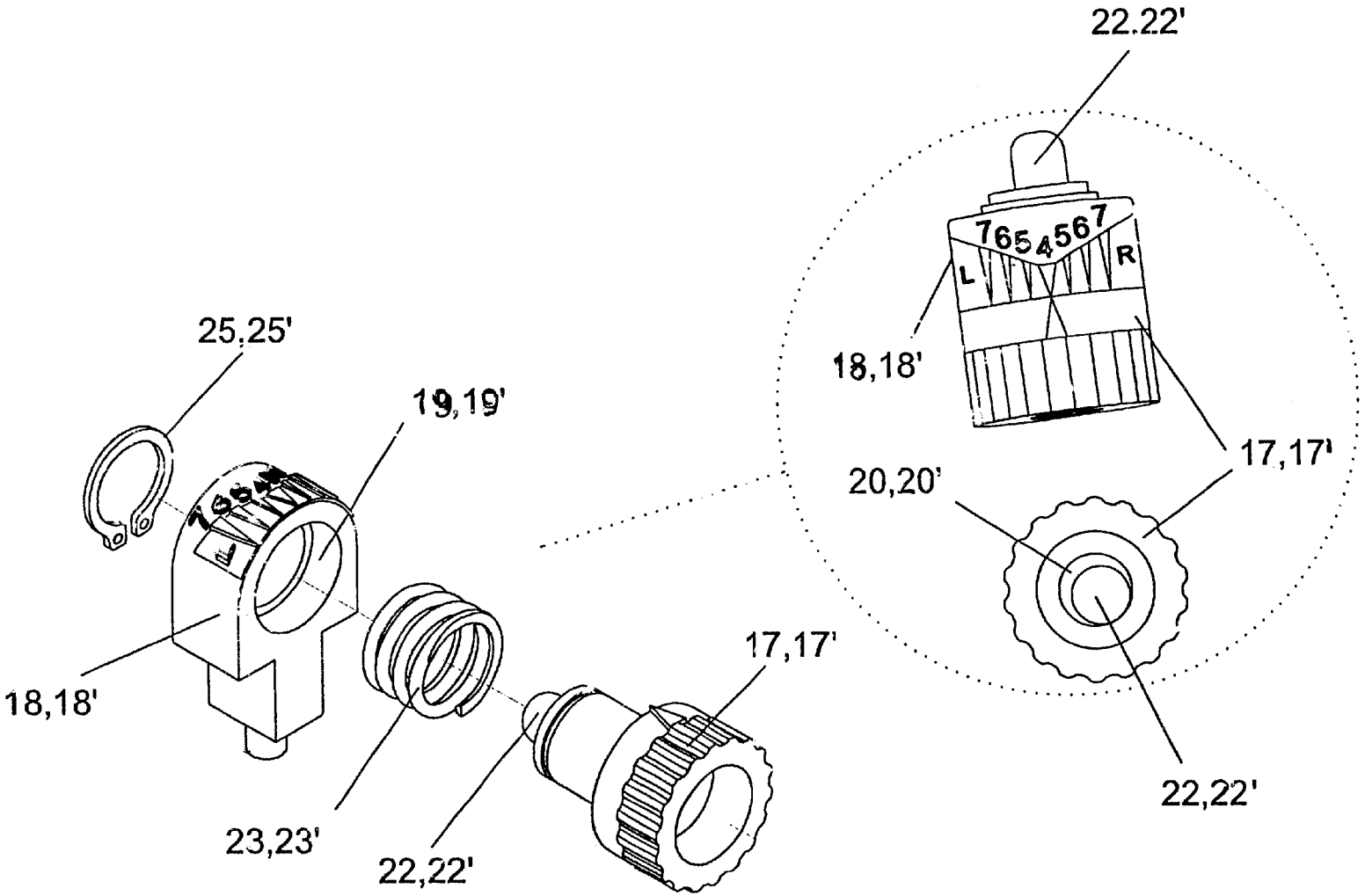
FIG. 9 is a perspective exploded view of a portion of the apparatus of FIG. 5

Referring now to FIGS. 5–9, which illustrate a second preferred embodiment of the present invention, an apparatus shown generally at 5' comprises a main body shown at 15' for mounting components of apparatus 5' thereon. The apparatus 5' preferably further includes a handle 100'; a tape roll holder 14'; a sleeve 18'; a guiding collar 17' rotationally mounted within opening 19' of sleeve 18' using a spring 23' and retaining ring 25' to permit adjustment of the width of fold of the tape (FIG. 7); a first compressing element 30' to compress confronting portions of the adhesive face of a tape and fold the tape upon itself; a second compressing element 40'; a rail 42 (as shown in FIG. 8) comprising a channel 44, the channel cooperating with the second compressing element 40' to bend at least one edge of tape; and a cutting blade 50'. Tape roll holder 14', guiding collar 17' and sleeve 18', compressing elements 30' and 40', rail 42 and cutting blade 50' are preferably aligned generally linearly on main body 15' in the direction of tape dispensing.

Guiding collar 17' preferably comprises a cylindrical core 22' eccentrically mounted within a central opening of the collar. The cylindrical core defines a curved space 20' within the guiding collar 17' to pass tape therethrough and form a segment of tape correspondingly curved in cross-section, wherein a portion of the adhesive face of the tape confronts another portion of the adhesive face. A free end of tape, therefore, is dispensed from a roll mounted on tape roll holder 14', through guiding collar 17' housed and rotationally mounted within sleeve 18', and passes out a curved, partially annular space 20' surrounding a cylindrical core 22'. The curved, partially annular space 20' is preferably centrally located within the guiding collar 17'.

As tape exits curved space 20', each segment of tape exiting the curved space is correspondingly curved in cross-section, with the bottom, sticky face of the curved segment being concave and the top, non-sticky face of segment being convex. That is, as the tape exits the curved space 20', the segment of tape is correspondingly curved in cross-section wherein a portion of the adhesive face of the tape confronts another portion of the adhesive face.

As seen best with reference to Section C–C' in FIG. 7, a segment of curved tape can pass under a first compressing element 30', which then folds the tape upon itself and compresses the confronting portions of the adhesive face of the tape together. The compressing element 30' may be a disengageable pinch roller (as shown in the figures), or may be a cylindrical bar, an edge of the apparatus, or any other like element that would compress the confronting portions of the adhesive face of the tape together. The inner faces of the panels 32' and 33' serve as a guide to position the curved tape as it enters under the first compressing element 30'.

A second compressing element 40' can optionally be included to provide a roller bearing for contacting the top (non-sticky) face of the tape as it is pulled toward the cutter blade 50'. Moreover, second compressing element 40' preferably cooperates with rail or channel 42 to bend at least one edge of the tape (FIGS. 7 and 8). In particular, rail or channel 42 has an inlet end 42*a* aligned and located closer to guiding collar 17' and an outlet/discharge end 42*b* located closer to cutting blade 50'. Rail or channel 42 is preferably tapered so that front inlet end 42*a* is wider than the back outlet end 42*b* to channel the already folded tape into channel 42 and bend the tape. The surface 40*a* of second compressing element 40' and the surface 43 of the bottom and sides of channel 42 are in contact with each other and preferably have equal areas. As seen best with reference to Section B–B' in FIG. 7, the second compressing element 40' cooperates with and fits flush within the bottom and sides of channel 42 to bend at least one edge of the tape across its width as the tape passes under compressing element 40'. Second compressing element 40' can also be disengaged so that the tape being dispensed from the apparatus is folded only and not bent.

Preferably, the apparatus comprises a forward bearing 48 located between the second compressing element 40' and cutting blade 50'. The bearing 48 provides a rigid structural support to aid in pulling and dispensing tape.

The guiding collar 17' mounted within opening 19' of sleeve 18' can be rotated within the sleeve 18' to adjust how much of the tape is folded over upon itself. Preferably, indicia is located on guiding collar 17' and/or sleeve 18' to mark and allow a user to fold certain widths of tape. The indicia aids the user in creating folded tape of varying widths, as desired. The fold width adjustment physically accomplished by a cylindrical core 22', which is eccentrically mounted within a central opening of the guiding collar 17'. The cylindrical core defines a curved space 20' within the guiding collar. However, a cylinder core is not necessary to establish or form a curved space in a guiding collar. A curved space may be routed or ground out of a solid material to form a guiding collar, for example.

A tape passes through curved space 20' and forms a segment of correspondingly curved tape in cross-section. The cylindrical core and curved space defined by the core move eccentrically within opening 19' of the sleeve 18' as the guiding collar 17' is rotated to vary the position and orientation of the partially annular space 20', and thereby vary the positioning of the curved tape as it enters the first compressing element 30'. A positional stop 61' (shown in FIG. 7) is preferably provided to limit the extent of rotation of the guiding collar 17'.

In a more preferred embodiment of the invention, rotation of guiding collar 17' against the stop 61*a*' in one direction allows dispensing of the tape with a fold stemming from the left edge of the tape. Rotation of guiding collar 17' against the stop 61*b*' in the other direction allows dispensing of the tape with a fold stemming from the right edge of the tape. Rotation of guiding collar 17' whereby an equal distance is achieved between the stop 61*a*' and an end of collar 17' in the first direction and between the stop 61*b*' and the other end of collar 17' in the second direction allows dispensing of the tape without a fold whereby the apparatus functions as a regular, non-folding tape dispenser. Rotation of the collar 17', against the stop in the either direction provides maximum folding of the tape. The fold width can be continuously varied between no fold and maximum fold by selective manipulation of the guiding collar 17'.

The roll holder 14' preferably includes one or more resilient retaining clips 70' for releasably holding or securing the roll 10' of tape thereon. The compressing elements, are carried within retaining slots 80', and springs 82' bias the compressing elements 30', 40' downwardly when the apparatus is loaded and in use. The retaining slots 80' include offsets, which allow the compressing elements 30', 40' to be held disengaged in a raised position for loading tape, and to be lowered into an engaged spring-biased position for folding, bending and dispensing tape.

A handle 100' is provided for grasping by a user. The handle 100' is preferably releasably affixed to the main body 15' of the apparatus 5', by means of a threaded stud 104' which extends through a hole in the body 15' and engages a threaded opening of a mounting clip 106'. The mounting clip 106' preferably comprises resilient jaws for releasably mounting the apparatus 5' onto a tool cart or other external structure during use on either the left or right sides of main body 15'.

Alternatively, if the apparatus is to be utilized as a portable hand tool, a nut 110' can be provided in place of the mounting clip 106'. Removal of the mounting clip 106' is preferred when utilized as a portable hand tool, in order to reduce the likelihood of the clip 106' scratching the finish of the object being painted. The handle 100' is reversible, and can be mounted on either side of the main body 15', depending upon whether the user is right-handed or left-handed. The main body 15' preferably comprises mounting lugs 120" for more secure engagement of the handle 100' and the mounting clip 106'. Preferably, the handle 100' can be mounted at two or more positions spaced along the main body 15' represented by mounting lugs 120" and 120"). The first position is offset laterally from second position to prevent interference with tape dispensing when clip-mounted to a structure. The apparatus 5, 5' of the present invention enables a method of operation, which will now be described as a method of operation.

Tape Loading Mode

In particular, in the first step of the tape loading mode, a tape roll (e.g., masking tape) is slid onto a roll holder or carousel 14, 14' of apparatus 5, 5' with the tape edge forward. Pinch rollers 30, 30' and 40, 40' are lifted into and engaged in offset portions of the retaining slots 80, 80' in the "up" position. Approximately a six inch section of the free end of the tape is folded in half twice (double folded). The now double folded free end of the tape is inserted through guide or adjustment collar 17, 17' and under the pinch rollers 30, 30' and 40, 40', which are still engaged in the "up" position. The tape is pulled forward until the double folded portion of the free end of the tape is past the cutting blade. The double folded portion is then cut off by the cutting blade and the remainder of the tape is ready to be dispensed.

Operation Modes

To dispense tape at its full width, keep pinch rollers 30, 30' and 40, 40', engaged in the "up" position in retaining slots 80, 80' and pull and cut tape as desired.

To fold tape as it is being dispensed from the apparatus, rotate guiding collar 17, 17' toward the "L" or "R" indicia located on the sleeve 18, 18'. "L" represents the side for a left hand fold and "R" represents the side for a right hand fold. The adjustment collar 17, 17' may be rotated fully or partially to either side depending on the desired width of the fold of tape. The pinch rollers 30, 30' and 40, 40', are engaged in the "up" position in offsets of the retaining slots 80, 80' until collar 17, 17' is rotated. After the collar is rotated toward the "L" or "R" position, pinch roller 30, 30' is disengaged from the "up" position and engaged in the "down" position. The tape is pulled and cut, as desired.

In a more preferred method to fold tape as it is being dispensed from the apparatus, guiding collar 17, 17' should initially be rotated fully toward the "L" or "R" indicia located on the sleeve 18, 18'. After approximately six inches of tape has been pulled with the collar 17, 17' rotated fully to the "L" or "R" side, the collar can again be rotated to a position for a desired fold width. The tape is pulled and cut, as desired.

The method of operation optionally comprises bending the tape as it is being dispensed. To fold and bend tape as it is being dispensed from the apparatus, rotate guiding collar 17, 17' toward the "L" or "R" indicia located on the sleeve 18, 18'. The adjustment collar 17, 17' may be rotated fully or partially to either side depending on the desired width of the fold of tape. The pinch rollers 30, 30' and 40, 40' are engaged in the "up" position in retaining slots 80, 80' until collar 17, 17' is rotated. After the collar is rotated, pinch rollers 30, 30' and 40, 40' are disengaged from the "up" position and engaged in the "down" position. The tape is pulled and cut, as desired.

Resetting Mode

Preferably, before rotating adjustment collar 17, 17' fully or partially to either side depending on the desired width of the fold of tape, return pinch rollers 30, 30' and 40, 40' to the engaged "up" position in retaining slots 80, 80'. Guiding collar 17, 17' is then rotated and adjusted as desired. However, pinch rollers 30, 30' and 40, 40' do not need to be in the "up" position to adjust roller 17, 17' and the resulting tape width.

Reloading Mode

When changing rolls of tape, tear the remaining tape from the roll so that the end is of the old tape is still yet to pass through the guiding and adjusting collar 17, 17'. Remove the empty tape roll from the tape holder or carousel 14, 14' and replace with a new tape roll. Contact and secure approximately a 1 inch leader of tape from the new roll to the old tape end in front of guiding collar 17, 17'. Pull tape through the guiding collar 17, 17' and out the dispensing end of the apparatus until tape from the new roll is dispensing.

While the invention has been described in its preferred forms, it will be readily apparent to those of ordinary skill in the art that many additions, modifications and deletions can be made thereto without departing from the spirit and scope of the invention being indicated by the following claims.

What is claimed is:

1. An apparatus for folding an adhesive face of tape upon itself comprising:

a guiding collar having a curved opening therethrough for receiving and passing a length of tape to form a curved segment of tape, wherein a portion of the adhesive face of the tape confronts another portion of the adhesive face;

a compressing element to compress the confronting portions of the adhesive face of the tape against one another and fold the tape upon itself; and a sleeve having the guiding collar rotationally mounted therein to permit adjustment of the width of fold of the tape.

2. The apparatus of claim 1 further comprising a main body having the guiding collar and compressing element mounted thereon, wherein the guiding collar and compressing element are aligned linearly in the direction of tape dispensing.

3. The apparatus of claim 1, wherein the compressing element is a pinch roller or a cylindrical bar.

4. The apparatus of claim 1, wherein the guiding collar and sleeve have indicia to mark different widths of fold of the tape.

5. The apparatus of claim 1, wherein the curved opening is defined by a cylindrical core mounted within an opening through the guiding collar.

6. An apparatus for folding an adhesive face of tape upon itself comprising:

a guiding collar having a curved opening therethrough for receiving and passing a length of tape to form a curved segment of tape, wherein a portion of the adhesive face of the tape confronts another portion of the adhesive face;

a compressing element to compress confronting portions of the adhesive face of the tape against one another and fold the tape upon itself;

means for bending at least one edge of the tape; and a sleeve having the guiding collar rotationally mounted therein to permit adjustment of the width of fold of the tape.

7. The apparatus of claim 6 further comprising a main body having the guiding collar, compressing element and means for bending mounted thereon, wherein the guiding collar, compressing element and means for bending are aligned linearly in the direction of tape dispensing.

8. The apparatus of claim 6, wherein the compressing element is a pinch roller or a cylindrical bar.

9. The apparatus of claim 6, wherein the curved opening is defined by a cylindrical core mounted within an opening through the guiding collar.

10. The apparatus of claim 6, wherein the means for bending comprises a rail having a front end aligned closer to the guiding collar and a back end, and wherein the rail is tapered so that the front end is wider than the back end.

11. An apparatus for folding an adhesive face of tape upon itself comprising:

an adjustable guiding collar having a curved opening therethrough for receiving and passing a length of tape to form a curved segment of tape, wherein a portion of the adhesive face of the tape confronts another portion of the adhesive face, and wherein the adjustable guiding collar varies the fold width of the tape;

a first compressing element to compress confronting portions of the adhesive face of the tape against one another and fold the tape upon itself; and a sleeve having the guiding collar rotationally mounted therein to permit adjustment of the fold width of the tape.

12. The apparatus of claim 11, wherein the compressing element is a pinch roller or a cylindrical bar.

13. The apparatus of claim 11, wherein the guiding collar and sleeve have indicia to mark different widths of fold of the tape.

14. The apparatus of claim 11, wherein the curved opening is defined by a cylindrical core mounted within an opening through the guiding collar.

* * * * *